United States Patent [19]

Rogers, Jr.

[11] 4,249,772

[45] Feb. 10, 1981

[54] WALL-AVOIDING RECLINER CHAIR

[76] Inventor: Walter C. Rogers, Jr., P.O. Box 685, Denton, N.C. 27239

[21] Appl. No.: 54,956

[22] Filed: Jul. 3, 1979

[51] Int. Cl.[3] ..... A47C 1/02

[52] U.S. Cl. ..... 297/85; 297/68; 297/317

[58] Field of Search ..... 297/85, 88, 89, 61, 297/84, 83, 68, 317, 327, 270

[56] References Cited

U.S. PATENT DOCUMENTS

| | | | |
|---|---|---|---|
| Re. 29,483 | 11/1977 | Re' | 297/88 |
| 3,284,131 | 11/1966 | Fletcher | 297/85 |
| 3,341,249 | 9/1967 | Fletcher | 297/85 |
| 3,550,952 | 12/1970 | Ferguson | 297/89 X |
| 3,958,827 | 5/1976 | Re' | 297/85 X |
| 4,077,663 | 3/1978 | Cycowicz et al. | 297/83 |
| 4,108,491 | 8/1978 | Rogers, Jr. | 297/85 |
| 4,185,869 | 1/1980 | Rogers, Jr. | 297/84 |
| 4,185,870 | 1/1980 | Johnson | 297/84 |

*Primary Examiner*—James T. McCall
*Attorney, Agent, or Firm*—William E. Mouzavires

[57] ABSTRACT

A wall-avoiding recliner chair wherein the seat and backrest move as a unit forwardly to a TV reclined position during which time the footrest is projected to extended position, and subsequently the seat and backrest may be moved relative to each other into advanced reclining positions with the footrest remaining extended. The chair is driven into TV position by the occupant moving the armrest forwardly while exerting pressure on the backrest. Subsequently, the chair is placed into advanced reclining positions by exerting pressure on the backrest. A carrier link is employed to suspend the seat therefrom while the carrier link is pivotally mounted to a fixed base by mounting links. The latter are actuated forwardly relative to the base by connection to the armrests. A sequencing linkage is utilized to prevent the backrest from pivoting relative to the seat until the TV position is reached. Subsequently, it permits a drive link connected to the backrest to swing the seat relative to the carrier link into advanced reclining positions when the chair occupant applies pressure on the backrest to move it relative to the seat into advanced reclining position. The footrest is actuated to extended TV position by an actuating link driven by a front carrier mounting link. The footrest is returned to retracted position from TV position by applying leg pressure on the footrest.

7 Claims, 3 Drawing Figures

WALL-AVOIDING RECLINER CHAIR

SUMMARY OF INVENTION

The present invention provides an improved linkage system for a three-way wall-avoiding recliner chair which is actuated through means of the armrests and the backrest as opposed to a handle actuator such as disclosed in my prior U.S. Pat. Nos. 4,071,275 and 4,108,491. A wall-avoiding recliner chair is a recliner chair which may be moved into reclining positions without the backrest striking a nearby wall. A three-way wall-avoiding recliner chair is such a wall-avoiding recliner chair wherein the seat is movable relative to a fixed base, and the backrest is movable, at least for certain movements of the chair, relative to the seat. Although the present invention is directed to a three-way wall-avoiding recliner chair, it is related in part to the two-way wall-avoiding recliner chair disclosure in my copending U.S. Application Ser. No. 815,293 to the extent that they both utilize the armrests in the actuation of the chair and footrest to a TV position; the latter being a position wherein the footrest is extended. In addition, both utilize a sequencing mechanism to prevent advanced reclining positions unless the footrest has been extended. However, the sequencing mechanisms are different in structure and in their orientation into the entire linkage system.

The improved linkage system of the present invention includes a seat link which is fixed to the seat and is suspended by a pair of mounting links from a carrier link which, in turn, is mounted relative to a fixed base by front and rear carrier mounting links. The armrest is also suspended from the carrier link by means of front and rear carrier mounting links. The front armrest mounting link is connected to the front carrier mounting link so that when the armrests are moved forwardly relative to the base, the carrier mounting links will be pivoted forwardly relative to the base to move the carrier link together with the seat link forwardly for placing the chair into a TV position with the footrest extended.

The footrest is mounted to the seat link and is actuated to its extended position by means of an actuating link connected to the footrest linkage and to the front carrier mounting link to be driven thereby when the armrests are moved forwardly relative to the base in the manner just described. During the latter motion, the carrier link and the seat link are prevented from moving relative to each other by means of a sequencing linkage which includes a slotted link pivotally mounted to the rear seat mounting link and a pin received in the slot and fixed to a portion of the rear armrest mounting link. This sequencing mechanism prevents the backrest from moving relative to the seat when the chair is moving from the normal or upright position to the TV position but after reaching the TV position, the sequencing mechanism permits the backrest to be pivoted rearwardly relative to the seat into an advanced reclining position during which time the seat is raised and moved into an advanced reclining position relative to the carrier link and the base.

The backrest has a backrest linkage including a link fixed to the backrest and pivoted to the rear portion of the seat link, and a backrest drive link pivotally connected to the backrest link and also pivotally connected to the rear seat mounting link so as to drive the latter forwardly and upwardly to move the seat relative to the carrier link into advanced reclining positions after the chair has reached the TV position.

A stop is provided on the carrier link to be engageable with one of the seat mounting links to limit and define the most advanced reclining position (fully reclined position) and another stop is provided to define the closed relative position of the carrier link and the seat, that is, when the chair is in the TV position.

Another stop is provided for defining the closed position of the carrier mounting links, that is when the chair is in the upright or normal position. Another suitable stop mechanism is provided in the footrest linkage to define the extended and retracted positions thereof.

DRAWINGS

The improved linkage system of the present invention will become more apparent and readily understood from the following detailed description taken in conjunction with the attached drawings in which.

DETAILED DESCRIPTION

Figure 1:
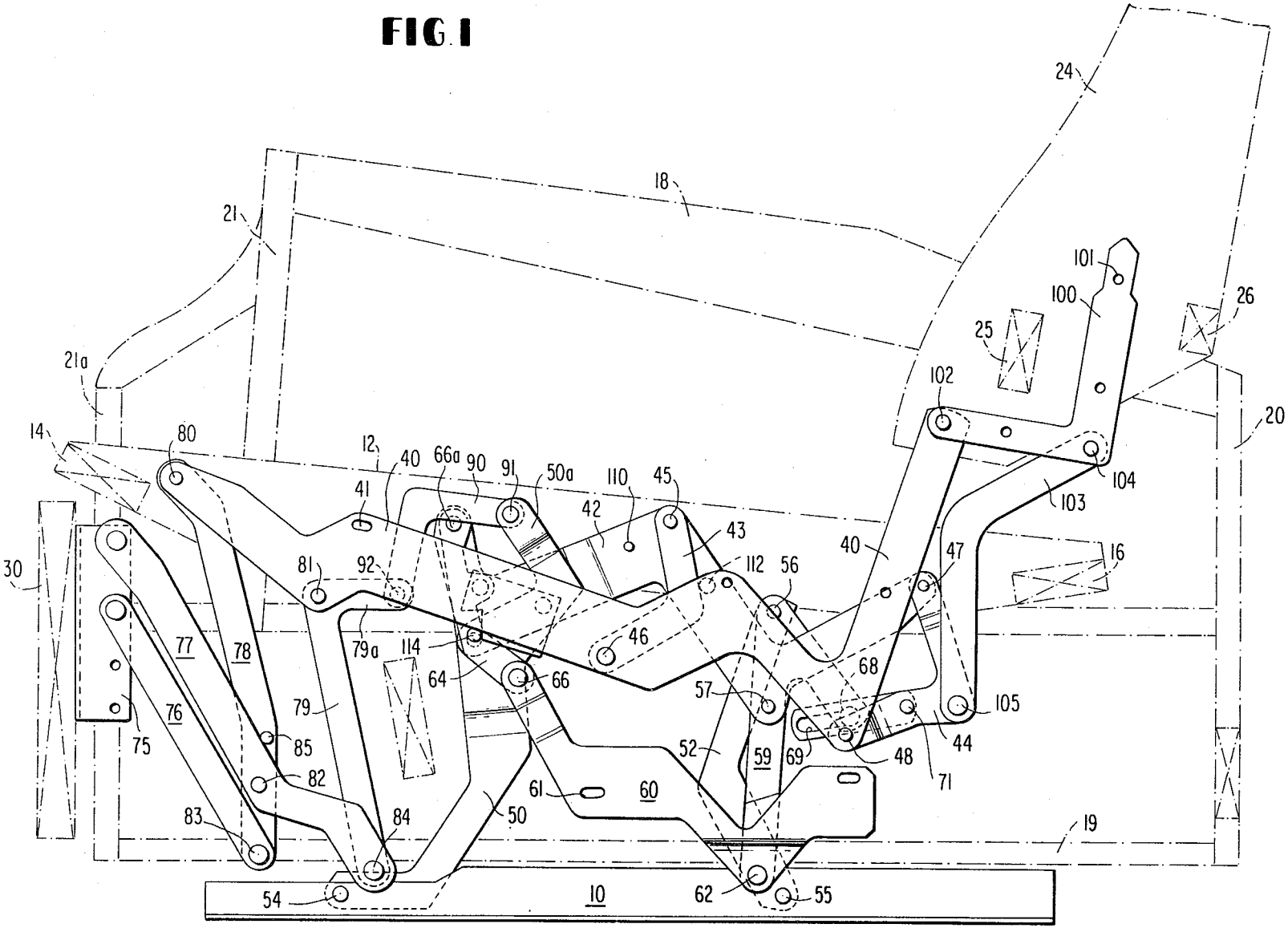
FIG. 1 is a side elevational view of a three-way wall-avoiding recliner chair shown in generally upright or normal position (also referred to as closed position) with the chair frame parts shown in phantom lines.

Referring now to the drawings, there is shown for illustrative purposes only, a three-way wall-avoiding reclining chair embodying the improved linkage system of the present invention; only one side of the chair being shown and it being understood that the other side of the chair which is not shown will incorporate a similar linkage system as that shown in the drawings. The following description will relate only to the linkage system employed on one side of the chair.

The chair includes a fixed base 10 which may be made from metallic bars in rectangular configuration or any suitable sturdy frame construction. The seat including its upholstery is generally designated 12 and it includes a front frame rail 14 and a rear frame rail 16 extending transversely between the sides of the seat. The armrests which are movable relative to the seat 12 include forwardly-rearwardly extending upper rails 18, front and rear vertical frame members 21, **21*a* and 20, and a bottom rail 19 extending forwardly and rearwardly of the chair. The backrest is generally designated 24 and it includes transversely extending frame members 25 and 26. As will be described in further detail below, the backrest is mounted for movement relative to the seat 12 during certain advanced stages of reclining movement of the chair. The footrest is generally designated 30 and it is mounted by a footrest linkage to be described below relative to the seat 12 to be moved between a retracted position shown in FIG. 1 and an extended position (TV position) shown in FIG. 2**.

The linkage system includes a seat link generally designated 40 extending in the forward-rearward direction of the chair and having a plurality of mounting apertures 41 through which fasteners are passed to rigidly secure the seat link relative to seat 12. The seat is suspended from what will be termed the "carrier link", generally designated 42 also extending generally in the forward-rearward direction of the chair. This suspension is achieved by what will be termed "front and rear seat mounting links" 43 and 44, respectively. Front seat mounting link 43 which has a generally L-shape, is connected at its upper end by pivot 45 to carrier link 42 and is connected by a pivot 46 at its lower end to seat link 40. Rear seat mounting link 44 which also has a generally L-shape is connected by pivot 47 to the rear end portion of carrier link 42 and is connected by pivot 48 to a lower rear end portion of seat link 40.

Carrier link 42 is mounted for movement relative to the base 10 by means of what will be referred to as a "front carrier mounting link" 50 and a "rear carrier mounting link" 52. Front carrier mounting link 50 is pivotally connected to carrier link 42 by means of pivot 53 (see FIG. 2) and is pivotally connected to base 10 by pivot 54. Rear carrier mounting link 52 is pivotally connected to base 10 by pivot 55 and is pivotally mounted relative to carrier link 42 by means of what will be referred to as a "rear armrest mounting link" 59 to be described later in greater detail. Rear carrier mounting link 52 is connected by pivot 56 to the rear armrest mounting link 59 which, in turn, is connected by pivot 57 to carrier link 42, whereby rear carrier mounting link is thus connected relative to carrier link 42.

The armrest is also suspended from carrier link 42 and this is achieved through what will be referred to as an "armrest link" 60 having apertures 61 therein through which it is rigidly secured by suitable fasteners to the frame of the armrest. Armrest link 60 is suspended from the carrier link by means of a front armrest link 64 and the rear armrest mounting link 59 described above. Front armrest mounting link 64 is pivotally connected to an upper forward portion of armrest link 60 and is further pivotally connected at its upper end by pivot **66*a* to the upper forward portion of carrier link 42. Rear armrest mounting link 59 is connected at its lower end portion by pivot 62 to armrest link 60 and as described above, is connected by pivot 57 to carrier link 42**.

Figure 3:
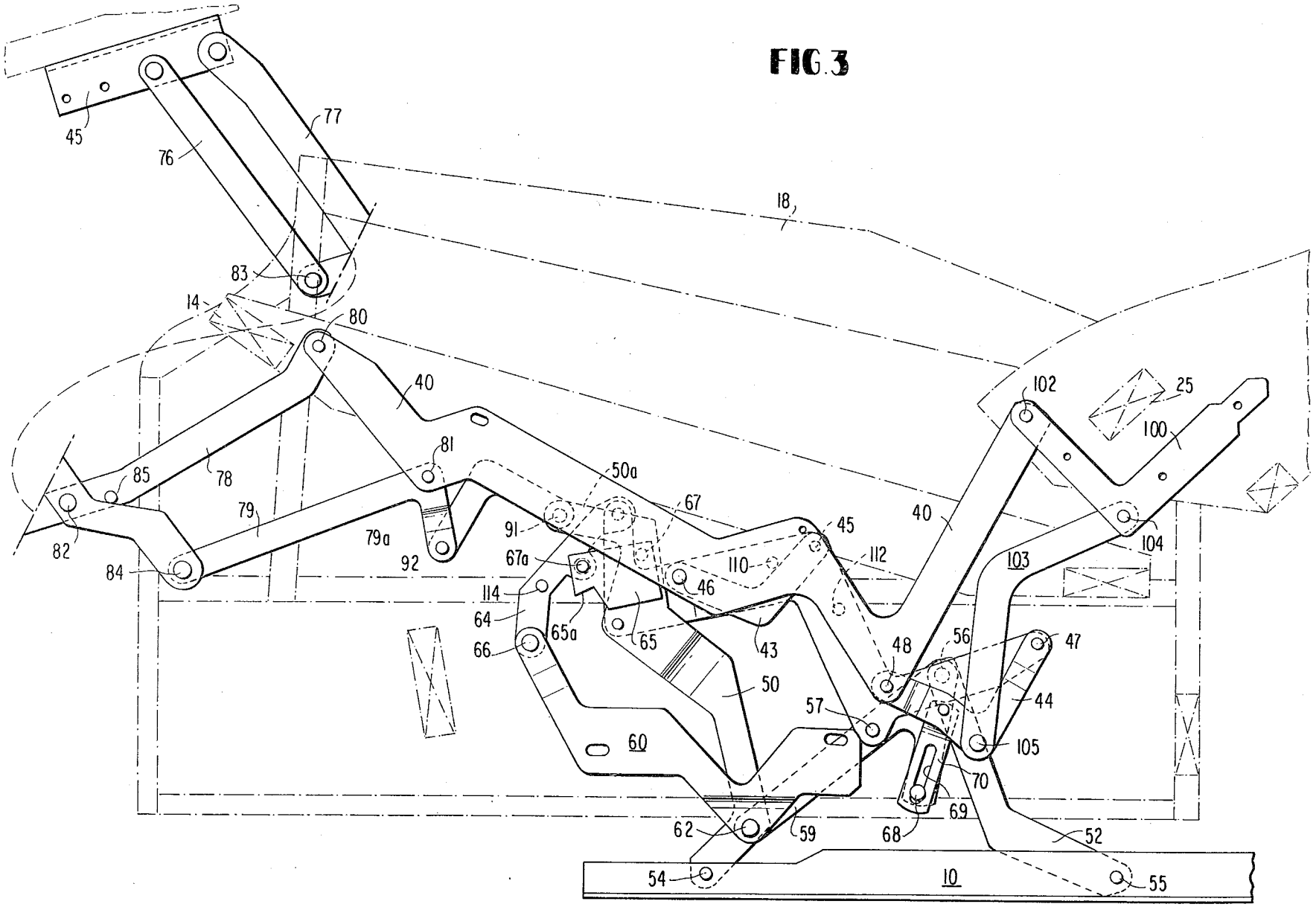
FIG. 3 is a view generally similar to FIG. 2 but showing the chair and its parts when in the fully reclined position.

Front armrest mounting link 64 also serves as a drive link for driving carrier mounting link 50 forwardly when the chair is moved into the TV position as will be described in greater detail. Referring to FIG. 3 which best shows the parts to be described, the latter is achieved through a connection between the front armrest link 64 and the front carrier mounting link 50; the connection being through a drive transmission link 65 pivoted by pivots **67*a* and 67 to the front armrest mounting link 64 and to front carrier mounting link 50. Link 65 is shown in the form of a small generally rectangular plate having a recess 65*a* for receiving a stop pin 114** to be described below.

Figure 2:
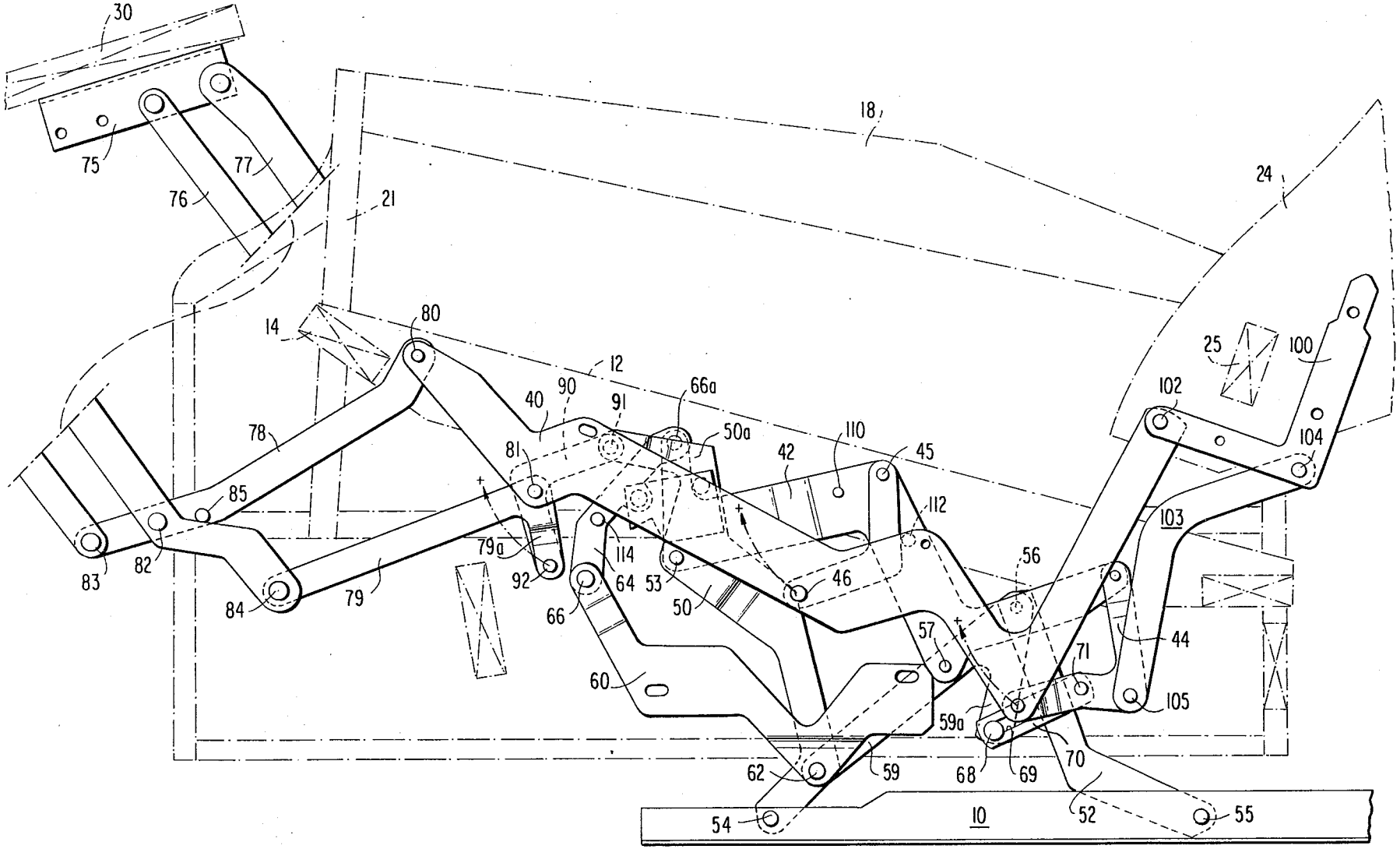
FIG. 2 is a view similar to FIG. 1 except showing the chair and the parts thereof when in the TV position.

When the chair is moved from the upright position shown in FIG. 1 to the TV position shown in FIG. 2, the occupant grasps the armrests and moves them forwardly while applying pressure on the backrest. This causes armrest link 60 to drive the lower portion of armrest mounting link 64 forwardly which, in turn by virtue of its connection through drive transmission link 65 to the front carrier mounting link 50, drives the latter forwardly about its pivot 54 to base 10 during which time seat link 40 moves as a unit together with carrier link 42 forwardly and does not pivot relative to the carrier link 42. Notice that when the chair is in the closed or normal position shown in FIG. 1, the front carrier mounting link 50 is to the right of its fulcrum, pivot 54, on the base so that once this link moves forwardly beyond pivot 54, the weight of the occupant will help to move the linkage parts to the TV position shown in FIG. 2 wherein link 50 has passed beyond its fulcrum 54. As will be described in greater detail, once the chair reaches the TV position shown in FIG. 2, seat link 40 may be pivoted into advanced reclining positions relative to the carrier link 42 by swinging the seat mounting links 43 and 44 forwardly by means of a backrest drive link 103 to be described. The arc of movement of links 43, 44 is shown in phantom arrows in FIG. 2.

In order to sequence seat link 40 relative to carrier link 42 so as to prevent relative movement between these links during the period when the chair is in upright position of FIG. 1 or when moving to the TV position of FIG. 2, a sequencing mechanism is provided. This mechanism includes a portion **59*a* of rear armrest mounting link 59 which extends to form a generally V-shaped configuration at the top of link 59. A stop pin 68 is fixed to an extremity portion of link 59*a* and is received in a sequencing slot 69 formed in a sequencing link 70 which is pivoted by pivot 71 to an intermediate portion of rear seat mounting link 44. When the chair is in the generally upright position shown in FIG. 1 or during the time it is traveling from the latter position to the TV position of FIG. 2, the stop pin 68 engaged against the side walls of the slot 69 will prevent the seat link and in turn the seat, from pivoting relative to carrier link 42 and thus seat link 40 will move together with carrier link 42 as a unit between the upright and TV positions of the chair. However, once the chair reaches the TV position of FIG. 2, the sequencing link 69, 70 and the link 59*a* including its pin 68 will be in such a geometrical relationship whereby seat mounting links 44 may be swung relative to carrier link 42 to place seat link 40 and its associated seat 12 into advanced reclining positions relative to carrier link 42 along the arc shown by the phantom arrows in FIG. 2. This action is achieved by the chair occupant exerting pressure on the backrest whose linkage now to be described will drive rear seat mounting link 44 to swing it forwardly about its pivot 47 which, in turn, will swing seat link 40 forwardly into advanced reclining position. Because of the weight distribution of the chair occupant and the geometry of the linkage system, the chair may be balanced in any advanced reclining position between TV position of FIG. 2 and fully reclined position of FIG. 3**. It should also be noted that although the elevation of the seat when in advanced reclining position is higher than TV position, the angle of the seat relative to the base changes only slightly.

The backrest linkage includes a primary link 100 having apertures 101 through which it is rigidly secured to the frame of backrest 24. Backrest link 100 is pivoted by pivot 102 to a rear upper end portion of seat link 40. A drive link 103 is provided so that it is pivoted at its upper end by pivot 104 to a lower portion of backrest link 100 and is pivoted at its lower end by pivot 105 to the rear seat mounting link 44. Once the chair reaches the TV position shown in FIG. 2, if the occupant desires to place the chair in a further reclining position beyond TV, he merely exerts pressure on the backrest which will cause backrest drive link 103 to swing the rear seat mounting link 44 forwardly and upwardly about its pivot 47 to carrier link 42 to pivot seat link 40, including the associated seat, into a desired advanced reclining position.

The footrest includes a footrest bracket link 75 fixed by any suitable means to footrest frame 30 and a pair of lazy tong type links 76 and 77 pivoted at their outer ends to footrest bracket link 75. Link 76 is pivoted at its lower end to a first footrest mounting link 78 by means of a pivot 83 while link 77 is also pivoted to link 78 by means of a pivot 82 so that links 76 and 77 extend generally parallel to each other in typical fashion. Link 77 extends beyond link 78 where it is connected by pivot 84 to another footrest mounting link 79 which in turn is connected by pivot 81 to seat link 40.

Acutation of the footrest linkage from the retracted position shown in FIG. 1 to the extended position shown in FIG. 2 is achieved by means of an actuating link 90 in the form of a bell crank pivotally connected at one end by pivot 91 to the upper end of front carrier mounting link 50 and pivotally connected at its opposite end by pivot 92 to a crank portion 79*a* of footrest mounting link 79. It will be seen that when front carrier mounting link 50 is swung forwardly when the chair is mounted into TV position, actuating link 90 will be moved forwardly and downwardly in angular motion in counterclockwise direction as viewed in the drawings to cause footrest mounting link 79 to be pivoted in clockwise direction (as shown in the drawings) to swing the footrest into the extended position. Moreover, it should be noted that when the chair moves from the TV position shown in FIG. 2 to any advanced reclining position such as the fully reclined position shown in FIG. 3, the actuating link 90 will act as an idler link pivoting in the clockwise direction (without actuating the footrest), thus permitting the footrest to be raised into the advanced reclining position, together with the seat as a unit. Since the angle of the seat changes only slightly when moving into advanced reclining position, the angle of the footrest relative to the seat need not be changed as is the case in the two-way reclining chair of my co-pending application identified above.

To summarize operation of the chair and assuming the chair is in the closed or generally upright or normal position shown in FIG. 1, in order to place the chair into the TV position, the occupant grasps the armrests 18 and moves them forwardly while exerting pressure on the backrest 24. This will cause carrier mounting links 50 and 52 to swing forwardly relative to the base 10 to extend the footrest while moving the seat together with the carrier link forwardly relative to the base carrying the backrest 24 with them away from any nearby wall. During this movement, the angle between the backrest 24 and the seat 12 remains fixed because the sequencing linkage 50*a*, 68, 70 will prevent any relative movement between the backrest and seat. Also, during this movement, it should be noticed that armrests 18 will have moved forwardly relative to seat 12, while seat 12 will have moved forwardly relative to base 10 which, of course, remains fixed.

After arriving in TV position such as shown in FIG. 2, should the occupant wish to move into an advanced reclining position, he merely pushes off the armrests to exert pressure on the backrest which will cause the backrest to pivot rearwardly relative to the seat around pivot 104 while, at the same time, moving the backrest drive link 103 forwardly to swing the rear seat mounting link 44 forwardly about its pivot 47 to carrier link 42. This will have the effect of swinging seat link 40 and its associated seat 12 upwardly into an advanced reclining position relative to the carrier link and the base during which time the sequencing stop 68 of link 59*a* will be riding in the slot 69 because sequencing link 70 will have been pivoted downwardly as shown in FIG. 3. The fully reclined or most advanced position will be determined by engagement of front seat mounting link 43 with a stop 110 fixed on carrier link 42. Should the occupant desire to return to a lesser advanced reclining position or TV position, he merely leans forward in the chair to redistribute his weight causing seat mounting links 43, 44 to swing downwardly about their pivots 45, 57. A stop 112 is fixed on carrier link 42 to engage the rear edge of front seat mounting link 43 to define the TV position of FIG. 2. To positively limit and define the closed position of the front carrier mounting linkage, s stop 114 may be provided on front armrest mounting link 64 to engage the front edge of drive transmission link 65 in its recess 65*a*. A suitable stop 85 may also be provided to positively limit the footrest in both its extended and retracted positions. Stop 85 may be fixed to footrest mounting link 78 to be engageable along the rear edge of link 77 in both the fully extended and retracted positions as illustrated in FIGS. 2 and 1.

In order to return the chair from the TV position of FIG. 2 to the closed or normal position of FIG. 1, the chair occupant exerts leg pressure downwardly on the extended footrest to retract the footrest. During this action, footrest actuating link 90 drives the front carrier mounting link 50 in clockwise direction until the link 50 goes beyond its fulcrum 54 at which time the occupant's weight will automatically provide all the energy needed to restore the linkage into the position shown in FIG. 1.

In the claims to the invention which follow, numerals have been utilized in order to help identify the claimed structure with reference to the specific preferred embodiment disclosed in the drawings and described above. These numerals however should not be construed to limit the scope of the claims to the specific embodiment shown.

What is claimed is:

1. In a three-way wall-avoiding recliner chair including a base, a seat mounted relative to the base for movement between a normal position and a plurality of reclining positions located forwardly along the base from the normal position of the seat, a backrest mounted relative to the seat for movement with the seat relative to the base between a normal generally upright position when the seat is in its normal position and a plurality of reclining positions located forwardly along the base from the normal position, said backrest also being pivotable relative to the seat for placing the chair into advanced reclining positions, armrests mounted to the seat for movement relative to the seat between a normal position when the seat is in its normal position, and an advanced position forwardly of its normal position, and a footrest mechanism mounted to the seat for movement between a retracted position adjacent the seat when the seat is in its normal position and an extended position projected forwardly from the seat when the seat is in a reclined position; an improved linkage system comprising a carrier link (42), a seat link (40) fixed relative to the seat, a pair of front and rear spaced seat mounting links (43, 44) each pivotally connected to the carrier link (42) and the seat link (40) for mounting the seat link and in turn the seat relative to the carrier link with the seat link suspended from the carrier link, a front carrier mounting link (50) pivotally connected to the base (10) and pivotally connected to a forward portion of the carrier link, a rear carrier mounting link (52) pivotally connected at a lower end portion thereof to the base, an armrest link (60) fixed relative to an armrest, a rear armrest link (59) pivotally connected to the armrest link (60) and pivotally connected to an upper portion of the rear carrier mounting link (52), a drive transmission link (65) interconnecting the front armrest mounting link (64) and the front carrier mounting link (50) to drive the front carrier mounting link when the armrest is moved from its normal position forwardly relative to the base, sequencing linkage means (59*a*, 68, 79, 70) connected to the rear seat mounting link (44) and the rear armrest mounting link (59) for preventing relative movement between the carrier link (42) and the seat link (40) when the footrest is moved from retracted position to extended position but thereafter permitting movement of the seat link relative to the carrier link for placing the seat into advanced reclining positions, a backrest linkage including a backrest link (100) fixed relative to the backrest and pivotally connected to a rear portion of the seat link (40), an other backrest link (103) pivotally connected to the first backrest link (100) and pivotally connected to the rear seat mounting link (44) for swinging the seat mounting links and in turn the seat link and the seat relative to the carrier link for placing the seat in advanced reclining positions after the footrest has been moved to extended position, said sequencing linkage means preventing pivoting movement of said other backrest link (103) and in turn the backrest relative to the seat until the footrest has been moved to extended position, a footrest linkage pivotally connected to the seat for moving the footrest between retracted and extended positions, a footrest actuating link (90) pivotally interconnected between the front carrier mounting link (50*a*) and the footrest linkage to drive the footrest linkage forwardly from the seat when the armrest is moved forwardly from its normal position relative to the base.

2. The improved linkage system defined in claim 1 wherein said sequencing linkage means includes a sequencing link (70) pivotally connected to the rear seat mounting link (44) and having a slot (69), and a portion of said rear armrest mounting link (59*a*) having a pin received in said slot.

3. The improved linkage system defined in claim 1 wherein after the footrest is in extended positon, said footrest actuating link (90) acts as an idler link moving relative to the front carrier mounting link (50) without driving the footrest to permit the footrest to be moved together with the seat as a unit into advanced reclining positions.

4. The improved linkage system defined in claim 2 wherein after the footrest is in extended position, said footrest actuating link (90) acts as an idler link moving relative to the front carrier mounting link (50) without driving the footrest to permit the footrest to be moved together with the seat as a unit into advanced reclining positions.

5. The improved linkage system defined in claim 2 wherein the rear armrest mounting link (59) is pivotally connected to the carrier link (42) intermediate the ends of the rear armrest mounting link (59).

6. The improved linkage system defined in claim 4 wherein the rear armrest mounting link (59) is pivotally connected to the carrier link (42) intermediate the ends of the rear armrest mounting link (59).

7. The improved linkage system defined in claim 4 including a stop fixed to the front armrest mounting link (64) and engageable with one of said drive transmission link (65) and the front carrier mounting link (50).

* * * * *